US008564385B2

(12) United States Patent
Scott et al.

(10) Patent No.: US 8,564,385 B2
(45) Date of Patent: Oct. 22, 2013

(54) COAXIAL CONCENTRIC NONLINEAR TRANSMISSION LINE

(75) Inventors: Michael C. Scott, Rockwell, TX (US); Steve E. Calico, Fort Worth, TX (US); Chris E. Williams, Mansfield, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 1015 days.

(21) Appl. No.: 12/192,290

(22) Filed: Aug. 15, 2008

(65) Prior Publication Data

US 2009/0051468 A1 Feb. 26, 2009

Related U.S. Application Data

(60) Provisional application No. 60/957,595, filed on Aug. 23, 2007.

(51) Int. Cl.
*H01P 3/00* (2006.01)
*H01P 3/06* (2006.01)

(52) U.S. Cl.
USPC ..... 333/242; 333/160

(58) Field of Classification Search
USPC ..... 333/160, 206, 242, 20, 243, 244, 245, 333/207
See application file for complete search history.

(56) References Cited

U.S. PATENT DOCUMENTS

| | | | | |
|---|---|---|---|---|
| 4,841,259 | A * | 6/1989 | Mayer | 333/17.2 |
| 5,608,415 | A * | 3/1997 | Sugawara | 343/731 |
| 6,023,201 | A * | 2/2000 | Lamesch et al. | 333/12 |
| 6,337,609 | B1 * | 1/2002 | Endou et al. | 333/160 |
| 7,498,978 | B2 * | 3/2009 | Seddon et al. | 342/202 |
| 7,515,114 | B2 * | 4/2009 | Kuroda | 343/846 |
| 7,724,098 | B2 * | 5/2010 | Scott et al. | 331/101 |

* cited by examiner

*Primary Examiner* — Dean O Takaoka
*Assistant Examiner* — Alan Wong
(74) *Attorney, Agent, or Firm* — Withrow & Terranova, PLLC

(57) ABSTRACT

A radio frequency source includes a coaxial non-linear transmission line. The coaxial non-linear transmission line may include a closed, non-magnetic, cylindrical outer conductor defining a cavity therein; and a plurality of stages enclosed by the outer conductor. Each stage may then includes an axial field solenoid wound about the outer conductor; a non-magnetic, cylindrical inner conductor disposed within the cavity and coaxially aligned with the outer conductor; a plurality of cylindrical ferrite switch elements, each defining a respective bore through which the inner conductor runs; and a plurality of inner and outer cups coaxially aligned with the inner and outer conductors, each defining a respective bore through which the inner conductor runs.

14 Claims, 2 Drawing Sheets

COAXIAL CONCENTRIC NONLINEAR TRANSMISSION LINE

The earlier effective filing date of U.S. Provisional Application Ser. No. 60/957,595, filed Aug. 23, 2007, in the name of the inventors Michael C. Scott, et al., and entitled "Coaxial Concentric Nonlinear Transmission Line", is hereby claimed under 35 U.S.C. §119. This application is also hereby incorporated by reference for all purposes.

BACKGROUND OF THE INVENTION

1. Field of the Invention

The present invention is directed to a non-linear transmission line, and, more particularly, to a coaxial concentric non-linear transmission line.

2. Description of the Related Art

The rectangular block method of construction utilized in current state-of-the-art nonlinear transmission lines is a limiting factor in the available output power from such devices.

The present invention is directed to resolving, or at least reducing, one or all of the problems mentioned above.

SUMMARY OF THE INVENTION

In a first aspect, the invention is a radio frequency source, comprising a coaxial non-linear transmission line. In a second aspect, the invention is a coaxial non-linear transmission line, comprising a closed, non-magnetic, cylindrical outer conductor defining a cavity therein; and a plurality of stages enclosed by the outer conductor. Each stage includes an axial field solenoid wound about the outer conductor; a non-magnetic, cylindrical inner conductor disposed within the cavity and coaxially aligned with the outer conductor; a plurality of cylindrical ferrite switch elements, each defining a respective bore through which the inner conductor runs; and a plurality of inner and outer cups coaxially aligned with the inner and outer conductors, each defining a respective bore through which the inner conductor runs.

BRIEF DESCRIPTION OF THE DRAWINGS

The invention may be understood by reference to the following description taken in conjunction with the accompanying drawings, in which like reference numerals identify like elements, and in which.

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

In the illustrated embodiment, a coaxial nonlinear transmission line comprises a periodic structure having essentially a lumped element transmission line topology. The method of construction utilizes cylindrical cup shaped and concentrically nested metal elements arranged so as to alternately create stage capacitances and inter-stage capacitances. Ferrite inductive elements are placed in parallel to the inter-stage capacitances and axially on the inner conductor of the line to form the non-linear switching component of the network.

Figure 1A:
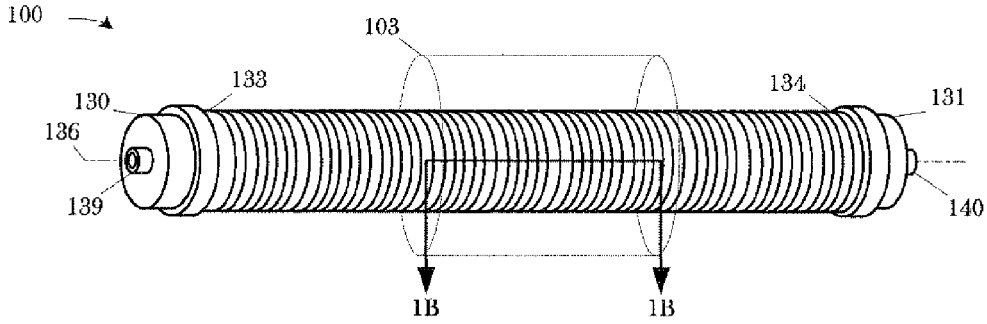
FIG. 1A-FIG. 1C illustrate one particular embodiment of the present invention.
Figure 1B:
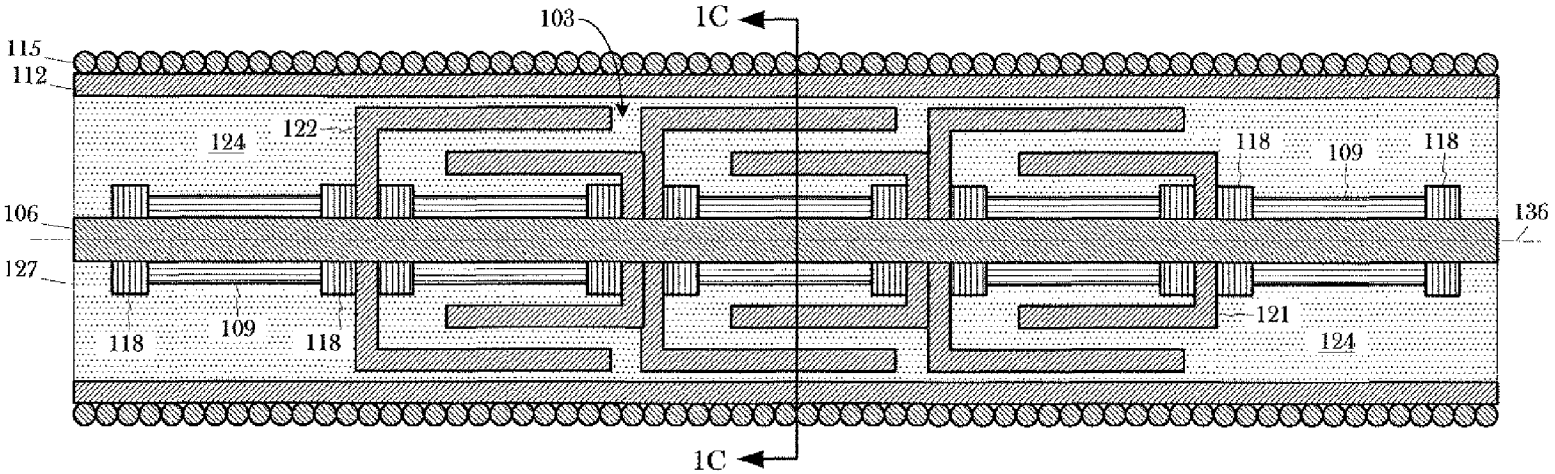
Figure 1C:
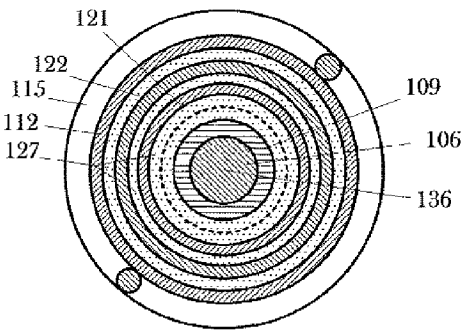

FIG. 1A-FIG. 1C illustrate one particular embodiment of a narrow band radio frequency signal source 100. FIG. 1A is an elevational, perspective view of one particular embodiment of the present invention. FIG. 1B is a cross-sectional view of several stages 103 of the source 100 in FIG. 1A taken along line 1B-1B in FIG. 1A. The source 100 will typically comprise several stages 103 and may be easily scaled by increasing the numbers of stages 103.

Referring now to both FIG. 1A-FIG. 1C, the source 100 is a new class of a RF source type known as "non-linear transmission line" ("NLTL"). The source 100 comprises an inner conductor 106 on which are mounted ferrite switch elements 109 (only two indicated) positioned within an outer conductor 112 about which an axial field solenoid 115 is wound. In the illustrated embodiment the ferrite switch elements 109 are spaced apart by dielectric spacers 118 (only four indicated), inner cups 121 (only one indicated), and outer cups 122 (only one indicated). In alternative embodiments, the dielectric spacers 118 may be omitted, or replaced by some other type of spacer, such as brass threaded nuts (not shown). The outer conductor 112 defines a cavity 124 filled with a dielectric material 127.

The dielectric material 127 is contained within the cavity 124 by a pair of endcaps 130, 131 threadably engaged with the outer conductor 112 at the ends 133, 134 thereof. Note that the manner in which the cavity 124 is enclosed is not material to the practice of the invention. The endcaps 130, 131 need not be threadably engaged and alternatives to the endcaps 130, 131 may be used in alternative embodiments. Furthermore, the dielectric material 127 is, in the illustrated embodiment, a fluid, and, more particularly, a liquid. The threaded engagement between the endcaps 130, 131 is therefore suitably sealed using conventional techniques (e.g., O-rings, fluid tight threads, etc., not shown) to prevent its escape. These techniques may not be needed in embodiments in which the dielectric material 127 is not fluid. The endcap 130 includes fittings 139 to receive an input and the endcap 131 includes fittings 140 for outputting an RF signal.

As can be seen from FIG. 1C, each of the inner conductor 106, ferrite switch elements 109, outer conductor 112, axial field solenoid 115, dielectric spacers 118, inner cups 121, and outer cups 122 has a circular cross-section. FIG. 1C is a cross-section of the source 100 taken along line 1C-1C of FIG. 1B. Each of these components is co-axially aligned with the central axis 136 of the source 100.

The inner conductor 106, outer conductor 112, inner cups 121, and outer cups 122 are fabricated from a non-magnetic, high conductivity material. Currently, certain metals are the only known materials that meet these requirements, but should other materials meeting these criteria become known they can also be used. More particularly, the inner conductor 106 is fabricated from brass and the outer conductor 112, inner cups 121, and outer cups 122 are fabricated aluminum.

These components may also all be manufactured from the same material if desirable. For example, in one alternative embodiment, the inner conductor 106 is also made from aluminum like the outer conductor 112, inner cups 121, and outer cups 122. Note that structural strength for outer conductor 112 is a consideration in this particular embodiment since it must support the threaded engagement with the endcaps 130, 131. The outer conductor 112 also encases the fluid dielectric material 127.

The dielectric material 127 is, in the illustrated embodiment, a dielectric oil. However, other dielectric materials, including materials in other states, may be desirable in alternative embodiments. For example, dielectric materials may include, but are not limited to, fluids, silicones, or dielectric compounds.

The ferrite switch elements 109 are cylindrical ferrite beads and may be fabricated from practically any ferrite material. Note, however, that the material selection will influence the frequency of the output signal. In the illustrated embodiment, the ferrite switch elements 109 are fabricated from Nickel-Zinc (NiZn). Other suitable ferrite materials include Manganese Zinc (MnZn) and Yittrium Iron Garnett (YIG).

Figure 2:
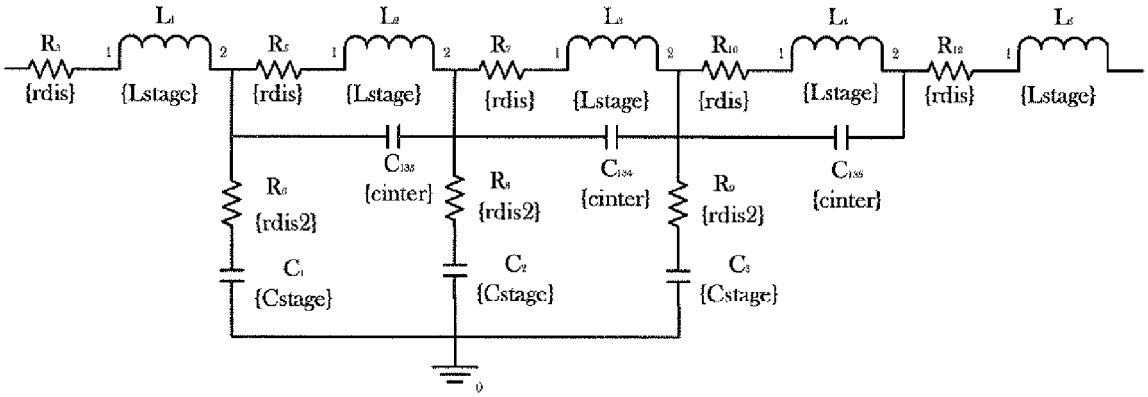
FIG. 2 depict a corresponding circuit diagram for a single stage of the source illustrated in FIG. 1A-FIG. 1C.

FIG. 2 depict a corresponding circuit diagram for a single stage of the source illustrated in FIG. 1A-FIG. 1C, the stages 103 illustrated in FIG. 1B.

Thus, the present invention is a nonlinear transmission line having a coaxial construction of cylindrical components. The present invention increases the output power available from nonlinear transmission lines by utilizing a cylindrical coaxial construction method. This geometry contributes to low electric field enhancement providing for high output powers, ease of construction, and reliability. It also provides for scaling to higher output powers. Material cost in construction will be reduced.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A radio frequency source, comprising a coaxial non-linear transmission line that, upon receiving an input, outputs a radio frequency signal, wherein the coaxial non-linear transmission line comprises:

a closed, non-magnetic, cylindrical outer conductor defining a cavity therein; and a plurality of stages enclosed by the outer conductor, each stage including:

an axial field solenoid wound about the outer conductor;

a non-magnetic, cylindrical inner conductor disposed within the cavity and coaxially aligned with the outer conductor;

a plurality of cylindrical ferrite elements, each defining a respective bore through which the inner conductor runs; and a plurality of inner and outer cups coaxially aligned with the inner and outer conductors, each defining a respective bore through which the inner conductor runs.

2. The radio frequency source of claim 1, wherein the coaxial non-linear transmission line is modular.

3. The radio frequency source of claim 1, wherein the radio frequency source is a narrow band radio frequency source.

4. The radio frequency source of claim 1, wherein each stage further comprises means for spacing the ferrite elements.

5. The radio frequency source of claim 4, wherein the spacing means comprises dielectric spacers.

6. The radio frequency source of claim 4, wherein the spacing means comprises brass threaded nuts.

7. The radio frequency source of claim 1, further comprising a pair of endcaps closing the cylindrical outer conductor.

8. The radio frequency source of claim 1, wherein the ferrite elements comprise cylindrical ferrite beads.

9. A coaxial non-linear transmission line, radio frequency source, comprising:

a closed, non-magnetic, cylindrical outer conductor defining a cavity therein; and a plurality of stages enclosed by the outer conductor, each stage including:

an axial field solenoid wound about the outer conductor;

a non-magnetic, cylindrical inner conductor disposed within the cavity and coaxially aligned with the outer conductor;

a plurality of cylindrical ferrite elements, each defining a respective bore through which the inner conductor runs; and a plurality of inner and outer cups coaxially aligned with the inner and outer conductors, each defining a respective bore through which the inner conductor runs.

10. The coaxial non-linear transmission line, radio frequency source of claim 9, wherein each stage further comprises means for spacing the ferrite elements.

11. The coaxial non-linear transmission line, radio frequency source of claim 10, wherein the spacing means comprises dielectric spacers.

12. The coaxial non-linear transmission line, radio frequency source of claim 10, wherein the spacing means comprises brass threaded nuts.

13. The coaxial non-linear transmission line, radio frequency source of claim 9, further comprising a pair of endcaps closing the cylindrical outer conductor.

14. The coaxial non-linear transmission line, radio frequency source of claim 9, wherein the ferrite elements comprise cylindrical ferrite beads.

* * * * *